US011041365B2

(12) United States Patent
Cook et al.

(10) Patent No.: US 11,041,365 B2
(45) Date of Patent: Jun. 22, 2021

(54) ANNULAR CONTROLLED SAFETY VALVE SYSTEM AND METHOD

(71) Applicants: Robert Bradley Cook, Mandeville, LA (US); Josh Gerard Clark, Youngsville, LA (US); Daniel Grady Teen, Mandeville, LA (US); Glenn Mitchel Walls, Madisonville, LA (US); Robert Anthony Picou, Houma, LA (US)

(72) Inventors: Robert Bradley Cook, Mandeville, LA (US); Josh Gerard Clark, Youngsville, LA (US); Daniel Grady Teen, Mandeville, LA (US); Glenn Mitchel Walls, Madisonville, LA (US); Robert Anthony Picou, Houma, LA (US)

( * ) Notice: Subject to any disclaimer, the term of this patent is extended or adjusted under 35 U.S.C. 154(b) by 123 days.

(21) Appl. No.: 16/428,608

(22) Filed: May 31, 2019

(65) Prior Publication Data

US 2019/0368312 A1 Dec. 5, 2019

Related U.S. Application Data

(60) Provisional application No. 62/679,396, filed on Jun. 1, 2018.

(51) Int. Cl.
*E21B 34/14* (2006.01)

(52) U.S. Cl.
CPC ..... *E21B 34/14* (2013.01); *E21B 2200/06* (2020.05)

(58) Field of Classification Search
CPC ..... E21B 34/00; E21B 34/06; E21B 34/08; E21B 34/085; E21B 34/10; E21B 34/101; E21B 34/14; E21B 2200/05; E21B 2200/06; E21B 23/01; E21B 43/122; E21B 43/123; E21B 17/06
See application file for complete search history.

(56) References Cited

U.S. PATENT DOCUMENTS 4,440,221 A * 4/1984 Taylor ..... E21B 34/08 166/106
5,167,284 A * 12/1992 Leismer ..... E21B 34/102 166/374
6,138,758 A 10/2000 Shaw et al.
6,513,594 B1 * 2/2003 McCalvin ..... E21B 34/10 166/320
2004/0060705 A1 4/2004 Kelley
2011/0132593 A1 6/2011 Phloi-montri et al.
2012/0152569 A1 6/2012 Frisby
(Continued)

*Primary Examiner* — David Carroll
(74) *Attorney, Agent, or Firm* — Jones Walker LLP

(57) ABSTRACT

A system for operating a downhole system in a wellbore having pressure inlet ports formed in the production tubing, the one or more pressure inlet ports extending through the production tubing between the annular area and the outer surface of the conduit, the one or more pressure inlet ports being situated below a first top sealing device relative to the conduit. The system includes an annular pressure control valve coupled to a metal conduit below the one or more pressure inlet ports in the wellbore, the annular pressure control valve being configurable in an open position and in a closed position, where the annular pressure control valve transitions between the closed position and the open position responsive to the annular pressure. The system includes a second bottom sealing device coupled to a bottom portion of the conduit below the annular pressure control valve.

32 Claims, 5 Drawing Sheets

(56) References Cited

U.S. PATENT DOCUMENTS

| | | | | |
|---|---|---|---|---|
| 2013/0192848 | A1* | 8/2013 | Patel | E21B 34/06 166/373 |
| 2015/0354315 | A1* | 12/2015 | Windegaard | E21B 43/123 166/374 |
| 2018/0171763 | A1* | 6/2018 | Malbrel | E21B 43/128 |

* cited by examiner

ANNULAR CONTROLLED SAFETY VALVE SYSTEM AND METHOD

CROSS-REFERENCE TO RELATED APPLICATIONS

This application claims the benefit of and priority to U.S. Provisional Patent Application No. 62/679,396 filed on Jun. 1, 2018, which is incorporated herein by reference.

BACKGROUND OF THE DISCLOSURE

The present disclosure relates to an annular controlled safety valve (ACSV) system and method, and more particularly, to the annular pressure control of the ACSV in a remedial application.

SUMMARY

Aspects described herein provide a system for operating a downhole system in a wellbore having pressure inlet ports formed in the production tubing, the one or more pressure inlet ports extending through the production tubing between the annular area and the outer surface of the conduit, the one or more pressure inlet ports being situated below a first top sealing device relative to the conduit. The system includes an annular pressure control valve coupled to a metal conduit below the one or more pressure inlet ports in the wellbore, the annular pressure control valve being configurable in an open position and in a closed position, where the annular pressure control valve transitions between the closed position and the open position responsive to the annular pressure. The system includes a second bottom sealing device coupled to a bottom portion of the conduit below the annular pressure control valve.

In normal practice, oil/gas wells (especially offshore) have a sub-surface control safety valve (SSCSV) in the tubing string which is operated via a hydraulic control line running from the wellhead to the SSCSV. A prior-art system that includes a conventional SSCSV 60 is shown in FIGS. 1A and 1B. The SSCSV 60 is opened and closed by the application and removal of pressure down the hydraulic control line. The SSCSV 60 is a safety mechanism used for emergency shut-off of the producing well at a point below the mudline should the need arise ((e.g. a hurricane topples the platform rendering the wellhead with its manual (or automatic) valves useless)).

Over an extended time period during the course of producing the well, it is not unusual for a hole(s) to develop in the production tubing string causing the flowing or shut-in well pressure to be present in the annular area between the production tubing and the well casing. This would normally require an expensive well workover operation to pull and replace the damaged production tubing. Alternatively, a tubing patch or straddle with a smaller diameter pipe could be run inside the production tubing across the damaged section of tubing. However, if necessary to run the tubing patch (liner) or straddle across the interval where the SSCSV 60 is placed would eliminate the functionality of the SSCSV 60 thereby losing the ability for emergency well control.

Other reasons for placement of a liner pipe through an existing production tubing with SSCSV 60 may be for improved production from the well such as a velocity string or installation of gas lifting ability. It may also be to allow continued production in a well where the SSCSV 60 has malfunctioned, possibly due to scale or loss of sealing ability.

The present disclosure addresses the drawbacks described above by providing a downhole safety control valve operated responsive to the annular pressure inside of the well.

DETAILED DESCRIPTION OF THE DISCLOSURE

Figure 1A:
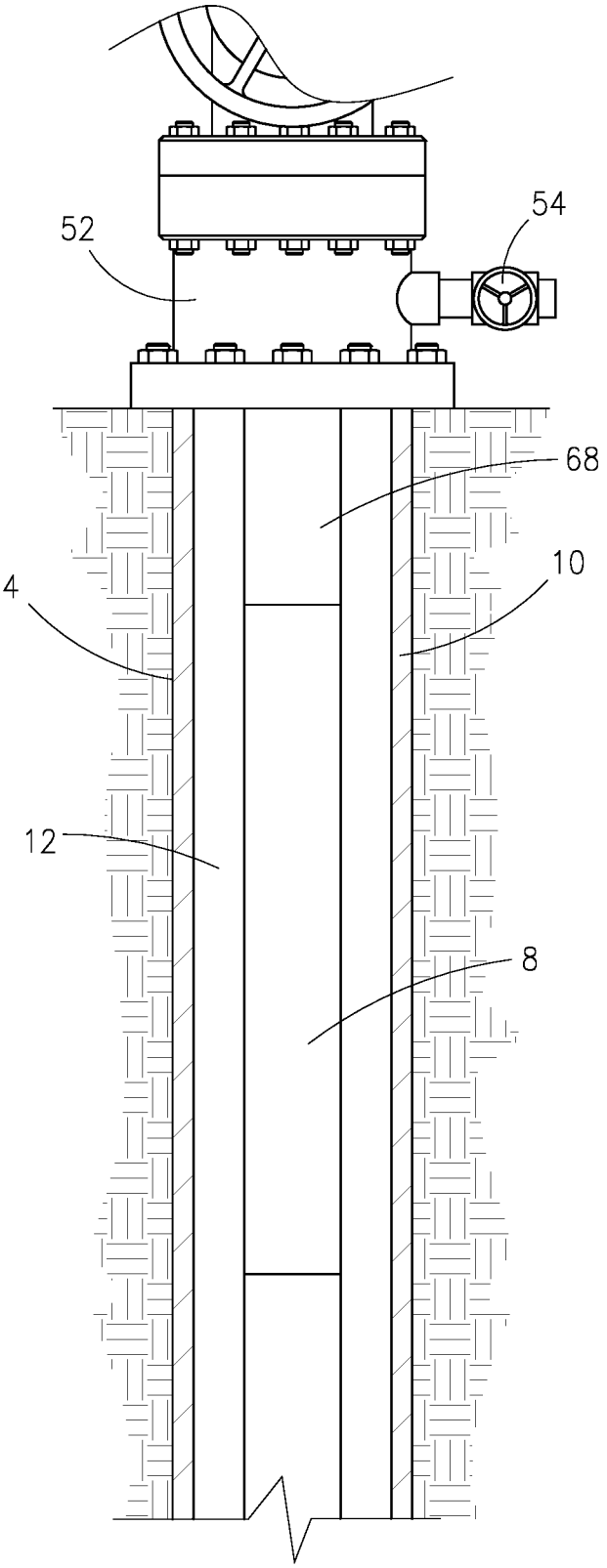
FIGS. 1A and 1B are partial cross-sectional views of a prior art sub-surface safety control valve in position in production tubing.
Figure 1B:
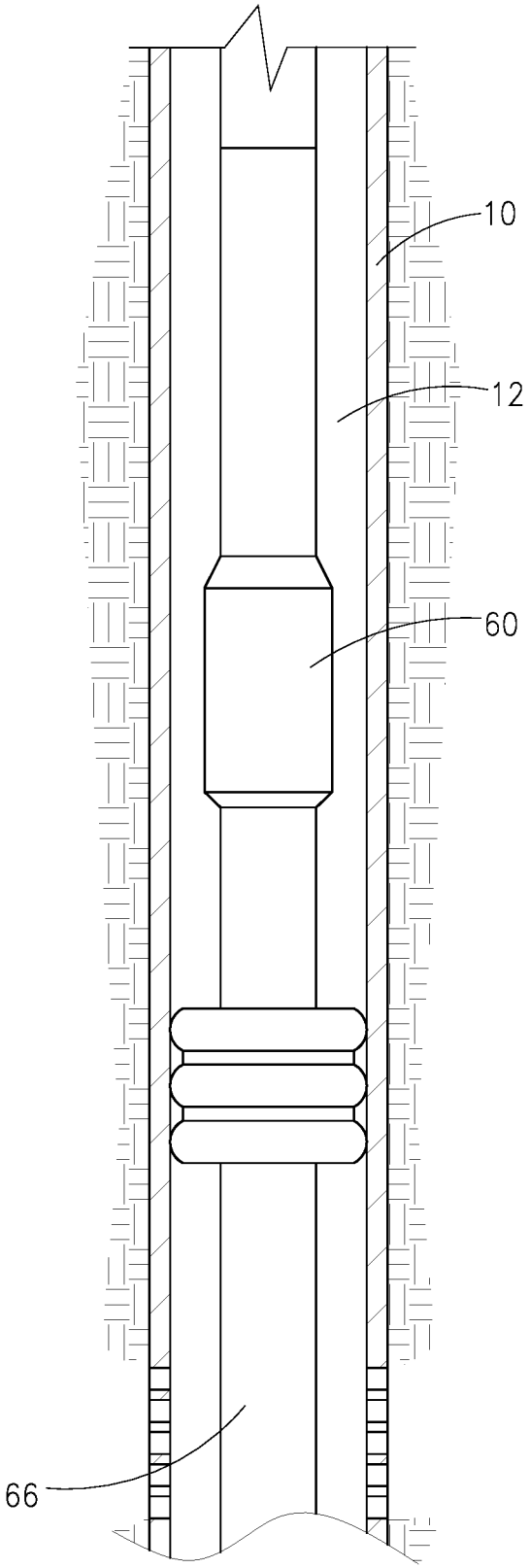
Figure 2A:
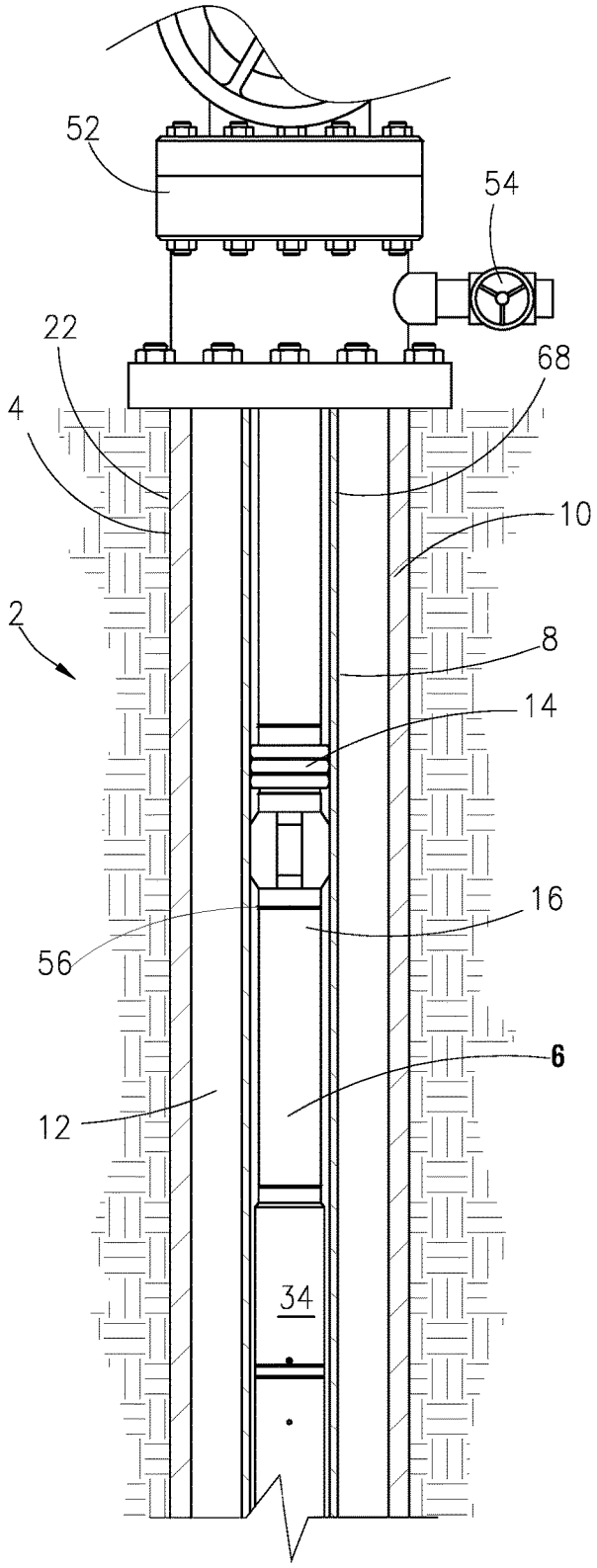
FIGS. 2A and 2B are cross-section views of an embodiment of downhole system of the present disclosure in position in production tubing.
Figure 2B:
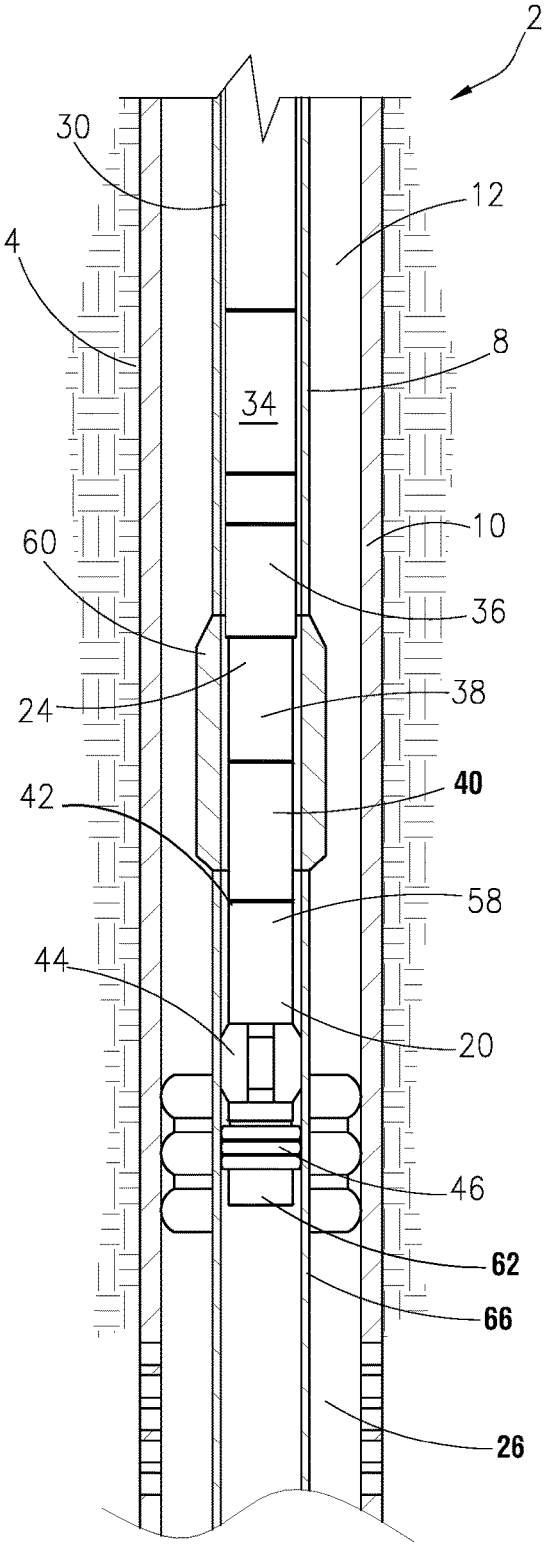

The present disclosure addresses the above drawbacks by providing a downhole system in a wellbore having an annular pressure control safety valve operated based on an annular pressure associated with a completion. For example, aspects disclosed herein provide a manner of having a safety valve in a wellbore when an original SSCSV has been rendered useless by corrosion, flow cutting, or a hole in tubing above the SSCSV that allows production to bypass the SSCSV (or other reason the SSCSV is unusable).

As shown in FIGS. 2-6, the downhole system 2 may extend in a wellbore 4 and may include an elongated tubular conduit 6, production tubing 8, production casing 10, a first top packer 14, an upper hang-off sub assembly 56, an annular pressure control valve 34, an upper stiff pup joint 36, a first sealing anchor latch 38, a first upper anchor assembly 40, a lower hang-off sub assembly 42, a lower stiff pup joint 58, a second sealing anchor latch 44, and a second bottom packer 46. The system 2 may also include a wellhead 52 and a casing valve 54.

In some embodiment, a stiff pup joint 36 may be coupled to the metal conduit 6 below the pressure control valve 34. A first sealing anchor latch 38 may be coupled to the metal conduit 6 below the stiff pup joint 36. A first upper anchor hanger assembly 40 having a dual seal bore may be coupled to the metal conduit 6 below the sealing anchor. A hang-off sub assembly 42 may be coupled to the metal conduit 6 below the first upper anchor hanger assembly 40. A second sealing anchor latch 44 may be coupled to the metal conduit 6 below the hang-off sub assembly 42. A second bottom packer 46 may be coupled to a bottom portion 20 of the conduit 6 below the second sealing anchor latch 44. In some embodiments, the bottom portion 20 of the conduit 6 may be located in a midsection 24 of the wellbore 4.

The conduit 6 (e.g., pipe, liner, patch, or straddle) may be coupled to the pressure control valve 34, which may be operated downhole in the wellbore 4. The conduit 6 may be any material suitable for operating in a downhole well. In one embodiment, the conduit 6 may be metal. The placement of the conduit 6 through an existing production tubing 8 with a SSCSV 60 may result in improved production from the well such as via a velocity string or installation of gas lifting ability. According to some aspects, the pressure control valve 34 may allow continued production in a well where the SSCSV 60 may have malfunctioned, such as due to scale or loss of sealing ability.

According to some aspects, the system 2 may include a conduit 6 with a annular controlled safety valve 34 (ACSV) that is sealed in two places (one above and one below the ACSV 34) inside the production tubing 8 (or the "casing" if it is a monobore completion that does not have production tubing 8). The two seals may be provided by any sealing mechanism or device. For example, a dual seal bore packer (e.g., packer 14 or packer 46) may be used to provide the seal. The dual seal bore packer may be a tool that may have an elastomeric element that is energized to create a seal. The dual seal bore packer may also have an anchor (e.g., anchor latch 38 or 44) that holds the packer 14 or 46 in position in the tubing 8 and is usually capable of supporting a certain amount of weight (as in the conduit 6). A sealing anchor latch device 38 or 44 can be landed into the top of the DSB packer 14 or 46. The bottom end of the packer 14 or 46 allows for coupling of other devices. The dual seal bore allows the packer 14 or 46 to be located and sealed in different places along the tubing 8 and may allow the packer 14 or 46 to be retrievable which allows for flexibility and for the long term maintenance of the system 2 in the well.

In a preferred embodiment, the system 2 may include packer 46 at the bottom of the production tubing 8 and make a straddle, which may be a system that has a seal on each end of assembly used to isolate an area on the outside between the two seals, in two runs by running the bottom packer 46 with a length of conduit 6 along with a sealing anchor latch 44. Once the sealing anchor latch 44 is engaged and sealed into the seal bore in the top end of the bottom packer 46, the upper packer 14 is set to provide the seal at the upper end section 22 of the wellbore 4. The length between the sealing devices (i.e., packers 14 and 46) can be varied by running more (or less) conduit 6 on the lower end of the top packer 14.

In some embodiments, the packer 14 or 46 might not be a dual seal bore packer and may be permanent, which may provide a lower cost alternative to the dual seal bore packer. For example, the bottom packer 46 may be permanently installed in the wellbore 4 because there might not be any need to retrieve the bottom packer 46 once set in the wellbore 4. In some embodiments, an inflatable packer 14 or 46 may be used in the system 2.

In some alternative embodiments, the upper or lower sealing mechanism may be provided by other devices, such as a pack-off. A pack-off is a sealing device set by compression from jar impact where an elastomer element is squeezed over a cone to engage the rubber to seal against the pipe wall of the tubing 8. A pack-off may use a profile to land and lock the pack-off in place (e.g., via an anchor stop) to set upon in order to be able to jar (hammering down), expand, and compress the seal element. The sealing mechanism may also be provided by a patch, which may be a piece of pipe (conduit 6) that is installed by swedging the ends of the pipe outward to the end tubing 8 to create a mechanically anchored metal to metal seal at each end of the pipe (conduit 6). The length can be varied by adding additional length of pipe because the ends are the part of the pipe that are deformed to land in production tubing 8. The sealing mechanism may also be provided by a liner that has an elastomeric seal on each end that may function similar to a patch, but with a compressed rubber seal on each end (and not swedging metal). In some embodiments, the upper sealing device may be placed in or on the wellhead 52 (instead of in the production tubing 8).

According to some aspects, the length of the conduit 6 may typically encompass substantially the entire depth of the production tubing 8 because of the likelihood of presence of multiple holes in the production tubing 8. In some embodiment, the use of a gas lift requires the gas to enter the production stream at the lowest desired point, and if another hole exists in the tubing higher up, it would allow the gas to enter too high and leave a remaining taller height of water/oil in the tubing which would exert additional unwanted hydrostatic pressure from this fluid column and may reduce the ability of the well to flow. However, providing the disclosed control valve 34 may only require a sufficient length of conduit 6 or tool body length to provide a seal on both sides of the ACSV 34 to direct the annular pressure into the housing of the ACSV 34.

In one embodiment, the straddle system run and set in the production tubing 8 includes (from the lower end 66 (in the bottom end section 26 of the wellbore 4) of the production tubing 8 on up to the upper end 68 (in the upper end section 22 of the wellbore 4) of the production tubing 8):

1. Bottom packer 46, such as with dual seal bore;
2. Sealing anchor latch 44;
3. Lower hang-off sub assembly 42, such as with a gas lift port/mandrel;
4. A first length of conduit 6;
5. Upper anchor hanger assembly 40, such as with dual seal bore;
6. Sealing anchor latch 38;
7. Upper stiff pup joint 36;
8. Annular pressure control valve 34, such as with an integral shear joint;
9. A second length of conduit 6; and
10. A top packer 14

According to some aspects, the annular pressure control valve 34 of the present disclosure is similar in design to current hydraulic control line SSCSV 60 widely used in oil well applications, but a hydraulic control line is not used with the disclosed annular pressure control valve 34.

The metal conduit 6 may be surrounded by the production tubing 8, and the production tubing 8 may be surrounded by a production casing 10. An annular pressure is exerted in an annular area 12 between the production casing 10 and the production tubing 8. The first top packer 14 may be coupled to a top portion 16 of the conduit 6.

The annular pressure control valve 34 may be coupled to the metal conduit 6 below one or more pressure inlet ports 28 formed in the production tubing 8 below the first top packer 14. The one or more pressure inlet ports 28 may extend between the annular area 12 (between the production casing 10 and the production tubing 8) and the outer surface 30 of the metal conduit 6 (e.g., through the production tubing 8). The one or more pressure inlet ports 28 may be situated below the first top packer 14 relative to the metal conduit 6.

Figure 3:
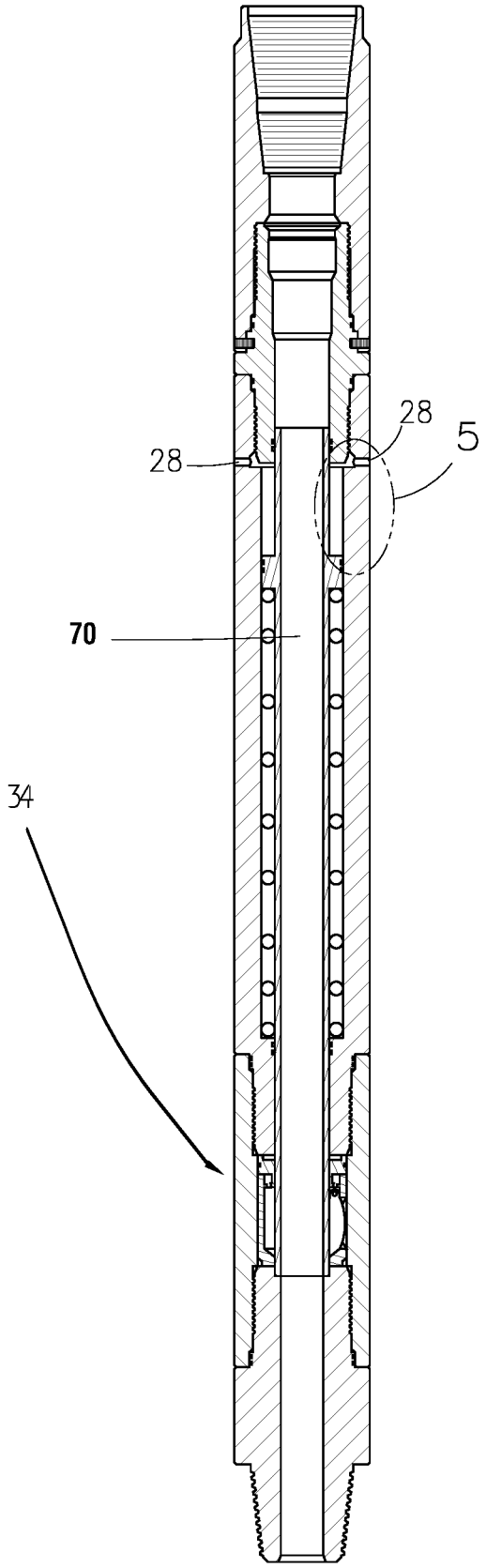
FIG. 3 is a cross-sectional view of an embodiment of the control valve of the present disclosure in open position.
Figure 4:
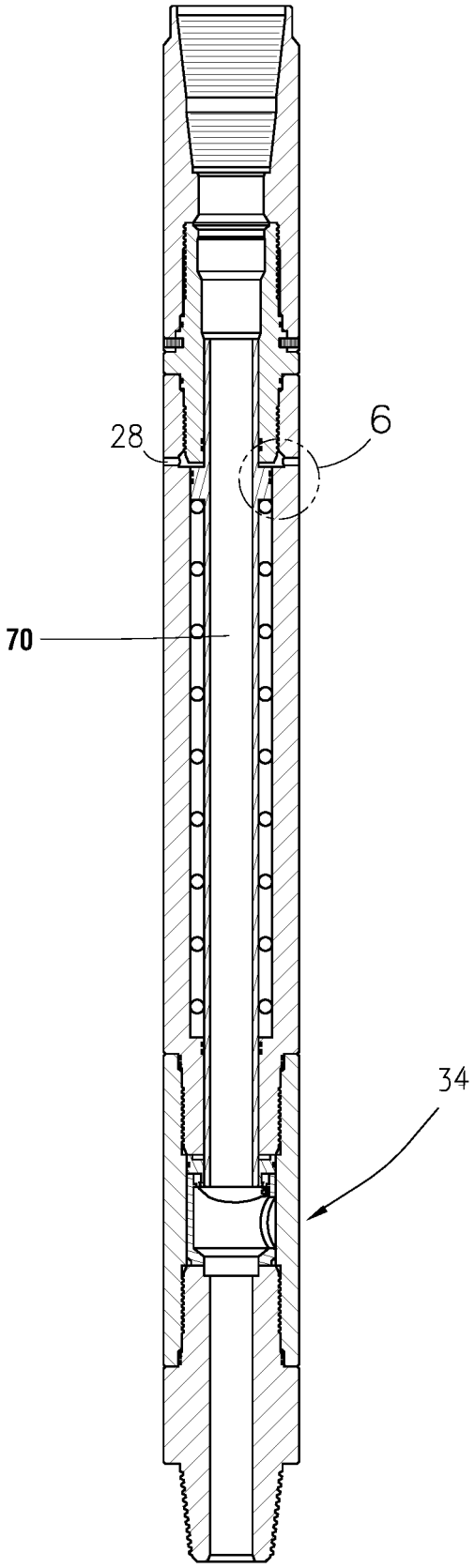
FIG. 4 is a cross-sectional view of the embodiment of the control valve shown in FIG. 3 in closed position.
Figure 5:
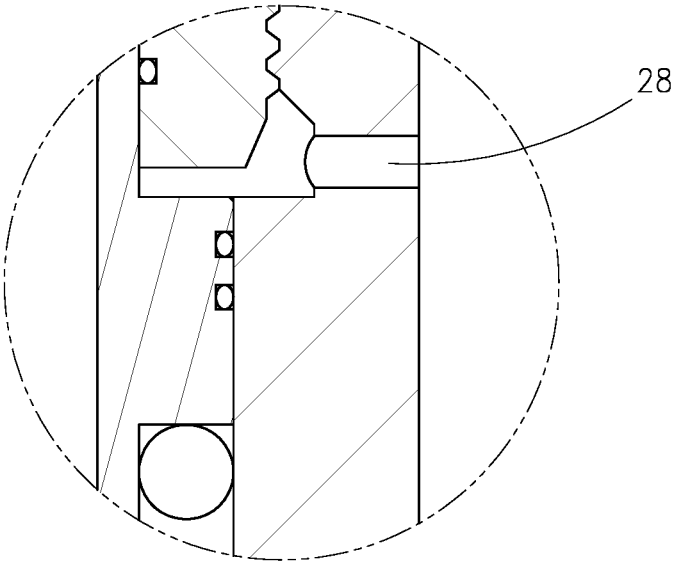
FIG. 5 is a view of an embodiment of an inlet port of the present disclosure.
Figure 6:
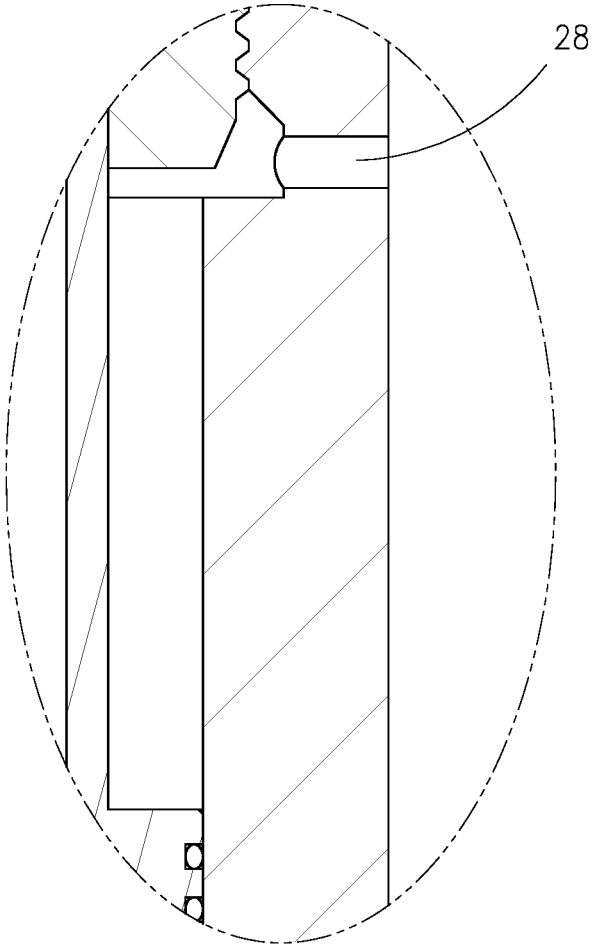
FIG. 6 is a view of an embodiment of an inlet port of the present disclosure.

The annular pressure control valve 34 may be configurable in an open position (FIG. 3) and in a closed position (FIG. 4). The annular pressure control valve 34 may transition from the closed position (FIG. 4) to the open position (FIG. 3) responsive to the annular pressure (i.e., provided by the one or more pressure inlet ports 28) being equal to or above a threshold value. The annular pressure control valve 34 may transition from the open position (FIG. 3) to the closed position (FIG. 4) responsive to the annular pressure being less than the threshold value.

In some cases, the threshold value may be based on the setting depth associated the completion. For example, the threshold value may be greater than the hydrostatic pressure of sea water present at a setting depth, such as set at about two times the hydrostatic pressure of sea water present at a setting depth. This may allow for the control valve 34 to remain shut in following a catastrophic emergency and/or damage to a component, such as the wellhead 52 and/or platform being swept away by a storm.

In some embodiments, a flapper valve is used as the sealing mechanism in the valve 34. For example, the flapper valve 34 may include an elongated arm that may attach at a hinge point or fulcrum point at one side of the conduit 6 or tubing 8. The flapper valve 34 may include a spring element. The elongated arm may pivot about the hinge/fulcrum point to open and/or close the valve 34 (i.e., responsive to the annular pressure). For example, the annular pressure may cause the valve to mechanically open and/or close. The flapper value 34 may function as an interior shut-off valve. A flapper valve 34 may allow for a more open flow area (as compared to other types of valves). The annular pressure may act upon an unbalanced piston 70 (disposed in the tubing 8) causing it to move in response to the pressure differential (FIG. 3). For example, a tubular-shaped piston 70 may pass through the flapper valve 34 to open it and then serve as a protective sleeve through which the subsequent production (oil) passes. This may act to prevent the production from flowing directly open the sealing component(s) of the flapper valve 34. When the production stops, the annular pressure may drop, and a spring element may return the piston 70 to the original position (FIG. 4), allowing the flapper valve to close and seal. The amount of pressure required to move the piston 70 may be based on the piston area and the spring rate.

In some embodiments, a ball valve may be used as the sealing mechanism in the valve 34. For example, a ball valve 34 may have a spherical shaped piece (ball) positioned between an outer sealing assembly having an opening for the spherical shaped piece (ball). The ball may have an opening formed through the ball and may rotate to expose the opening to the inner opening of the conduit 6 ("opened position") and may rotate to expose the non-opened portion of the ball to the inner opening of the conduit 6 ("closed position").

In some embodiments, a sleeve valve may be used as the sealing mechanism in the valve 34. In some embodiments, a poppet valve may be used as the sealing mechanism in the valve 34. For example, a poppet may be a rubber coated spring-loaded valve that may open or close in response to the presence of absence of pressure action upon the seal area.

The pressure ports 28 are situated in the upper portion of the system 2 and allow the pressure surrounding the system 2 to be used to operate the valve 34 at whatever position the valve 34 is placed in the wellbore 4.

The pressure control valve 34 of the present disclosure may be run in the closed position and opened by application of the pressure in the annulus 12 between the production tubing 8 and the casing 10. The control of the valve 34 may be passively operated when pressure is supplied by a gas injected into the annulus 12 for gas lift through a gas lift mandrel (e.g., included in or attached to the hang-off sub assembly 56) installed in the production tubing. In some embodiments, if no gas lift mandrel is installed, a hole can be added in the tubing 8 above the SSCSV 60 that may be isolated by an upper straddle segment.

In some embodiments, the pressure from a hydraulic control line associated with the SSCSV 60 (which may be already present in the wellbore 4) may be used to provide the pressure to operate the control valve 34. For example, if the exiting SSCSV 60 is rendered unusable or useless (e.g., via corrosion, flow cutting, hole in tubing 8, etc.), a top seal and a bottom seal (as described herein) may be put on either sides of the existing SSCSV 60 and the control valve 34 placed in the tubing 8 between those two seals may operate to provide a safety valve.

In some embodiments, the control valve 34 of the present disclosure may include a shear mechanism to allow the a portion of the tubing 8 in the upper section 22 of the wellbore 4 to be pulled off, while leaving the control valve 34 functionally intact to maintain well control.

The inclusion of the control valve 34 in the liner/patch/straddle system 2 installation may be configured in such a manner that the annular pressure is accessible to the control valve 34. In normal straddle applications, the ends 66 and 68 of the tubing 8 are sealed via elastomeric pack-off or metal-to-metal seal "elements." However, having a seal on the straddle below the location of the control valve 34 would prevent the annular pressure from reaching the control valve 34. To allow the annular pressure to reach the control valve 34, the present disclosure may use and include an anchor/hanger assembly 40 or a packer 14 without a packing element at the upper end 22 that suspends the weight of the liner string system 2, but still allows the annular pressure to make its way to the control valve 34. This makes the operation of the control valve 34 passive and automatic with the presence or absence of annular pressure.

The present disclosure has an upper packer set 14, where the control valve 34 is installed below and latched into the anchor/hanger assembly 40 to complete the upper end seal (to complete the production flow path to the wellhead 52). This allows the annular pressure to reach the control valve 34. In the event of catastrophic wellhead 52 removal, such as a storm, the wellhead 52 may be pulled off and the production tubing 8 may be pulled and/or part at some point in the well. The upper straddle segment may be released from the upper end of the control valve 34 and the control valve 34 would remain for well control.

In an alternative embodiment, the system 2 can also be run as one continuous straddle with the control valve 34 in place below the upper sealing packer 14.

The straddle system further incorporates a latching profile (e.g., sealing latch 38 and/or 44) for a drop/pump down sealing dart below.

Running the control valve 34 in conjunction with the straddle system is necessary to allow for full well control during a well failure event. This application gives the operator control of the well when the annular pressure in excess of the control valve cracking pressure is removed. The control valve 34 may be spring loaded, and may be capable of multiple opening/closing cycles (i.e., open at >=300 psi, close at <300 psi). The terms "about," "approximately," and "substantially" as used herein will be understood by persons of ordinary skill in the art and will vary to some extent on the context in which they are used. If there are uses of the term which are not clear to persons of ordinary skill in the art given the context in which it is used, "about" and "approximately" will mean +/−10% of the particular term and "substantially" will mean +/−15% of the particular term.

While preferred embodiments of the disclosure have been described, it is to be understood that the embodiments described are illustrative only and that the scope of the disclosure is to be defined solely by the appended claims when accorded a full range of equivalence, many variations and modifications naturally occurring to those skilled in the art from a perusal hereof.

What is claimed is:

1. A system for operating a downhole system in a wellbore, comprising:

an elongated tubular conduit extending downhole in the wellbore, the conduit being surrounded by a production tubing, wherein the production tubing is surrounded by a production casing, wherein an annular pressure is exerted in an annular area between the production casing and the production tubing;

a first top sealing device coupled to a top portion of the conduit;

one or more pressure inlet ports formed in the production tubing, the one or more pressure inlet ports extending through the production tubing between the annular area and the outer surface of the conduit, wherein the one or more pressure inlet ports are situated below the first top sealing device relative to the conduit;

an annular pressure control valve coupled to the conduit below the one or more pressure inlet ports, the annular pressure control valve being configurable in an open position and in a closed position, wherein the annular pressure control valve transitions from the closed position to the open position responsive to the annular pressure being equal to or above a threshold value, and wherein the annular pressure control valve transitions from the open position to the closed position responsive to the annular pressure being less than the threshold value;

a second bottom sealing device coupled to a bottom portion of the conduit below the annular pressure control valve; and a hydraulic-controlled safety valve coupled to the conduit below the annular pressure control valve.

2. The system of claim 1, wherein the annular pressure control valve comprises an integral shear joint configured to allow production tubing attached to an upper end of the conduit to be pulled off while leaving the control valve functionally intact to maintain well control.

3. The system of claim 1, wherein the annular pressure is derived from flowing or shut-in well pressure.

4. The system of claim 1, wherein the pressure control valve is non-hydraulic controlled.

5. The system of claim 1, further comprising a hang-off sub assembly coupled to the conduit below the annular pressure control valve, wherein the hang-off sub assembly comprises a gas lift mandrel.

6. The system of claim 5, wherein the annular pressure is provided by gas injected into the annular area via the gas lift mandrel.

7. The system of claim 1, further comprising a hang-off sub assembly coupled to the conduit below the annular pressure control valve, wherein the annular pressure is provided via a hole in the tubing positioned below the hang-off sub assembly relative to the conduit.

8. The system of claim 1, wherein the first top sealing device comprises a first top packer and the second bottom sealing device comprises a second bottom packer, wherein the first top packer and the second bottom packer are sealing packers and are part of a straddle system associated with the wellbore, wherein the second bottom packer is positioned at the lower end of the production tubing, and the top sealing packer is positioned at the upper end of the production tubing, wherein the straddle system is configured to allow production and well control in the event of an emergency.

9. The system of claim 8, wherein the emergency includes damage to a wellhead or platform associated with the wellbore.

10. The system of claim 1, wherein the first top sealing device is part of a straddle system, wherein the first top sealing device is set in the production tubing, wherein the control valve is shearably attached to the first top sealing device to allow removal of the first top sealing or an attached wellhead and maintain well control.

11. The system of claim 1, wherein a first elongated portion of the conduit extends between the first top sealing device and the annular pressure control valve.

12. The system of claim 1, wherein the threshold value is based on the setting depth.

13. The system of claim 12, wherein the threshold value is set to greater than the hydrostatic pressure of sea water present at a setting depth.

14. The system of claim 12, wherein the threshold value is set to about two times the hydrostatic pressure of sea water present at a setting depth.

15. The system of claim 1, further comprising a wellhead and a casing valve attached to a top portion of the wellbore.

16. The system of claim 1, wherein the annular pressure control valve includes a sealing mechanism having a flapper valve, wherein a piston disposed in the production tubing moves in the production tubing to open or close the flapper valve responsive to the annular pressure.

17. The system of claim 1, wherein the annular pressure control valve includes a sealing mechanism having a ball valve, sleeve valve, or a poppet valve.

18. The system of claim 1, wherein the threshold value is about 300 psi.

19. The system of claim 1, wherein the first top sealing device comprises a packer, a pack-off, a patch, or a liner.

20. The system of claim 1, wherein the second bottom sealing device comprises a pack-off, a patch, or a liner.

21. A method for operating a downhole system in a wellbore, comprising the steps of:

(a) providing an elongated tubular conduit extending downhole in the wellbore, the conduit being surrounded by a production tubing, wherein the production tubing is surrounded by a production casing, wherein an annular pressure is exerted in an annular area between the production casing and the production tubing; a first top sealing device coupled to a top portion of the conduit; one or more pressure inlet ports formed in the production tubing, the one or more pressure inlet ports extending through the production tubing between the annular area and the outer surface of the conduit, wherein the one or more pressure inlet ports are situated below the first top sealing device relative to the conduit; an annular pressure control valve coupled to the conduit below the one or more pressure inlet ports, the annular pressure control valve being configurable in an open position and in a closed position, wherein the annular pressure control valve transitions from the closed position to the open position responsive to the annular pressure being equal to or above a threshold value, and wherein the annular pressure control valve transitions from the open position to the closed position responsive to the annular pressure being less than the threshold value; a second bottom sealing device coupled to a bottom portion of the conduit below the annular pressure control valve; and a hydraulic-controlled safety valve coupled to the conduit below the annular pressure control valve; and (b) transitioning the annular pressure control valve from the closed position to the open position responsive to the annular pressure being equal to or above the threshold value.

22. The method of claim 21, further comprising:

(c) transitioning the annular pressure control valve from the open position to the closed position responsive to the annular pressure being less than the threshold value.

23. The method of claim 21, wherein the threshold value is based on the setting depth.

24. The method of claim 23, wherein the threshold value is set to greater than the hydrostatic pressure of sea water present at a setting depth.

25. The method of claim 23, wherein the threshold value is set to about two times the hydrostatic pressure of sea water present at a setting depth.

26. The method of claim 21, wherein the threshold value is about 300 psi.

27. A method for operating a downhole system in a wellbore, comprising the steps of:

(a) providing an elongated tubular conduit extending downhole in the wellbore, the conduit being surrounded by a production tubing, wherein the production tubing is surrounded by a production casing, wherein an annular pressure is exerted in an annular area between the production casing and the production tubing; a first top sealing device coupled to a top portion of the conduit; one or more pressure inlet ports formed in the production tubing, the one or more pressure inlet ports extending through the production tubing between the annular area and the outer surface of the conduit, wherein the one or more pressure inlet ports are situated below the first top sealing device relative to the conduit; an annular pressure control valve coupled to the conduit below the one or more pressure inlet ports, the annular pressure control valve being configurable in an open position and in a closed position, wherein the annular pressure control valve transitions from the closed position to the open position responsive to the annular pressure being equal to or above a threshold value, and wherein the annular pressure control valve transitions from the open position to the closed position responsive to the annular pressure being less than the threshold value; a second bottom sealing device coupled to a bottom portion of the conduit below the annular pressure control valve; and a hydraulic-controlled safety valve coupled to the conduit below the annular pressure control valve; and (b) transitioning the annular pressure control valve from the open position to the closed position responsive to the annular pressure being less than the threshold value.

28. The method of claim 27, further comprising:

(c) transitioning the annular pressure control valve from the closed position to the open position responsive to the annular pressure being equal to or above the threshold value.

29. The method of claim 27, wherein the threshold value is based on the setting depth.

30. The method of claim 29, wherein the threshold value is set to greater than the hydrostatic pressure of sea water present at a setting depth.

31. The method of claim 29, wherein the threshold value is set to about two times the hydrostatic pressure of sea water present at a setting depth.

32. The method of claim 27, wherein the threshold value is about 300 psi.

* * * * *